United States Patent [19]

Stout et al.

[11] Patent Number: 4,616,701

[45] Date of Patent: Oct. 14, 1986

[54] WELL PERFORATING APPARATUS INCLUDING AN UNDERBALANCING VALVE

[75] Inventors: Gregg W. Stout, Montgomery; William D. Myers, Jr., Woodlands, both of Tex.

[73] Assignee: Baker Oil Tools, Inc., Houston, Tex.

[21] Appl. No.: 742,095

[22] Filed: Jun. 6, 1985

[51] Int. Cl.[4] ..... E21B 43/116

[52] U.S. Cl. ..... 166/55.1; 166/297; 175/4.56

[58] Field of Search ..... 166/55.1, 55, 55.2, 166/120, 297, 298, 133, 188; 175/4.52, 4.54, 4.56; 137/68 R

[56] References Cited

U.S. PATENT DOCUMENTS

| | | | |
|---|---|---|---|
| 4,299,287 | 11/1981 | Vann et al. | 166/297 |
| 4,375,240 | 3/1983 | Baugh et al. | 166/120 X |
| 4,393,929 | 7/1983 | Akkerman | 166/120 X |
| 4,512,406 | 4/1985 | Vann et al. | 175/4.56 X |
| 4,538,680 | 9/1985 | Brieger et al. | 166/55.1 X |

*Primary Examiner*—Stephen J. Novosad
*Assistant Examiner*—Thuy M. Bui
*Attorney, Agent, or Firm*—Norvell & Associates

[57] ABSTRACT

A well perforating apparatus includes an underbalancing valve for opening ports in a tubing string immediately subsequent to the firing of a perforating gun, and comprises a hollow conduit having at least one pair of axially aligned, and radial holes traversing the wall of the conduit. A frangible member has its end portions slidably and sealably mounted in such holes and is therefore disposed transversely to the path of a detonating bar which is dropped to initiate the firing of the perforating gun. Upon breakage of the frangible member, the ends of the bar are forced inwardly out of the holes by the fluid pressure differential existing between the interior and exterior of the conduit due to the underbalanced fluid pressure condition achieved in the tubing string prior to firing the perforating gun.

9 Claims, 4 Drawing Figures

WELL PERFORATING APPARATUS INCLUDING AN UNDERBALANCING VALVE

BACKGROUND OF THE INVENTION

1. FIELD OF THE INVENTION

The invention relates to a well perforating gun incorporating a valve. Upon firing of the gun, the valve is operated to open ports in the tubing string to permit immediate flow of production fluid upwardly through the tubing string.

2. HISTORY OF THE PRIOR ART

The procedure for effecting the perforation of a production formation of a subterranean well in a so-called "underbalanced" condition is an expedient well-known in the art. Briefly, the procedure contemplates the suspension of a packer and a perforating gun on a tubing string. The packer is set above the production formation so as to position the perforating gun adjacent the formation. Steps are then taken to reduce the fluid pressure in the tubing string to a level substantially below the anticipated fluid pressure to be developed by the production formation after perforation; for example, the tubing string may be filled with a light-density fluid, or a swabbing operation conducted therein. The perforating gun is discharged and then one or more ports or fluid passages in the wall of the tubing string adjacent the production formation are opened so as to permit an immediate flow of production fluid from the perforated formation into the tubing string and up to the surface of the well. Due to the pressure differential, or the "underbalanced" condition of the well at the time of perforating, the flow from the production formation is generally quite rapid and results in a flushing of the debris normally resulting from a perforating operation from the perforations in the production formation. The removal of such debris greatly enhances the productivity of the well.

A number of valving devices have heretofore been proposed for opening ports in the tubing string immediately adjacent the production formation subsequent to the firing of the perforating gun. For example, U.S. Pat. No. 4,299,287 to VANN proposes to use a freely falling detonating bar to shift a sleeve valve mounted in series relationship between the tubing string and the perforating gun. Other valving mechanisms are disclosed in the co-pending application Ser. No. 6-551,764, filed Nov. 14, 1983, and assigned to the Assignee of the invention. All of these prior art underbalancing valves were characterized by the incorporation of relatively complex mechanisms with the attendant risk that such mechanisms would fail to operate and thus defeat the entire purpose of perforating the well in an underbalanced condition.

SUMMARY OF THE INVENTION

This invention provides an underbalancing valve in the form of a single sub that may be threadably interconnected between the top end of a tubing-carried perforating gun and the bottom end of the tubing string. Such sub comprises a hollow conduit having one or more pairs of axially aligned, radial holes formed in the sidewalls thereof. The axis of each pair of holes preferably comprises a diameter of the bore of the hollow housing. A frangible rod or plug is then inserted through each pair of holes and thus traverses the bore of the housing. The ends of the frangible rod are provided with sealing elements to effect a seal of the particular hole that it is inserted in. Each rod end is slidable relative to the hole that it is inserted in, but is prevented from passing out of the hole by a snap ring engaging the end of the rod.

Upon the dropping of a detonating bar through the tubular string and through the bore of the housing to impact upon a primer located in the upper ends of the perforating gun, the detonating bar will successively contact the various frangible rods and effect the breakage of such rods. The remaining ends of the rods, if any, are then displaced inwardly by any pressure differential existing outside of the housing over the tubing pressure. Since in a typical underbalanced perforating operation the tubing pressure is substantially less than the anticipated fluid pressure subsequent to the perforating operation, the remaining ends of the frangible rods are thus readily moved inwardly into the conduit and, hence, open each of the holes in which they were mounted for free flow of production fluids from the newly perforated formation. Thus, the full benefits of underbalanced perforating are obtainable with a high degree of assurance of success, since the perforating gun cannot be fired by the detonating bar unless all of the frangible rods disposed above the primer of the perforating gun are successively broken by the fall of the detonating bar. Upon such breakage, the remaining ends of the rods are readily displaced from their sealing position in the holes in the conduit by the fluid pressure differential and permit a free flow of pressured fluids from the newly perforated formation into the bore of the tubing string.

As an additional advantage in the use of the present invention, build up of solid contaminants on the firing head is eliminated by provision of the present device which permits debris to pass across it, thereby not interferring with the downward travel of the bar. Moreover, the present invention also may be utilized to permit pressure within the tubing string conduit thereabove to be "held" for activation of a hydraulically or pneumatically set well packer apparatus.

Further advantages of the invention will be readily apparent from the following detailed description, taken in conjunction with the annexed sheets of drawings, on which is shown a preferred embodiment of the invention.

DESCRIPTION OF THE PREFERRED EMBODIMENT

Figure 1:
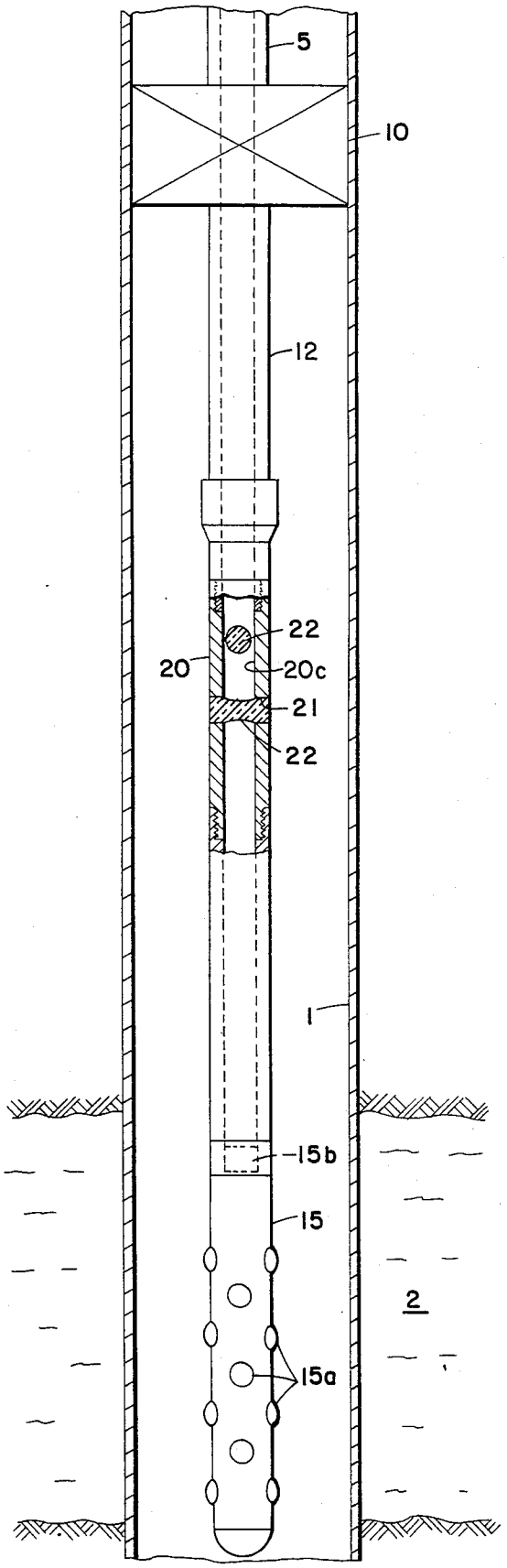
FIG. 1 is a schematic sectional view of a subterranean well with a perforating gun and underbalancing valve embodying this invention mounted therein.

Referring to FIG. 1, there is schematically illustrated the environment in which an underbalancing valve embodying this invention is employed. A packer 10 is set at a location within the subterranean well 1 so as to position a depending perforating gun 15 in a position adjacent to a production zone 2. Packer 10 may be any conventional tubing-carried type that is settable either by application of fluid pressure or by manipulation of the tubing string 5. The perforating gun 15 likewise is of conventional construction and incorporates a plurality of shaped charges 15*a* disposed in angular and vertically spaced relationship. An impact detonatable primer 5*b* is mounted above the shaped charges 15*a* and connected thereto by a conventional primer cord (not shown). The perforating gun 15 is suspended from the packer 10 by a hollow conduit 12 which, in effect, constitutes a continuation of the tubing string 5.

Serially connected in conduit 12 is an underbalancing sub or conduit 20. The top end of conduit 20 is threadably and sealably secured to the bottom end of conduit 12 and the bottom end of conduit 20 is sealingly secured to the top end of the perforating gun 15. Thus, conduit 20 is located in closely adjacent relationship to the production zone 2 which is to be perforated.

Figure 3:
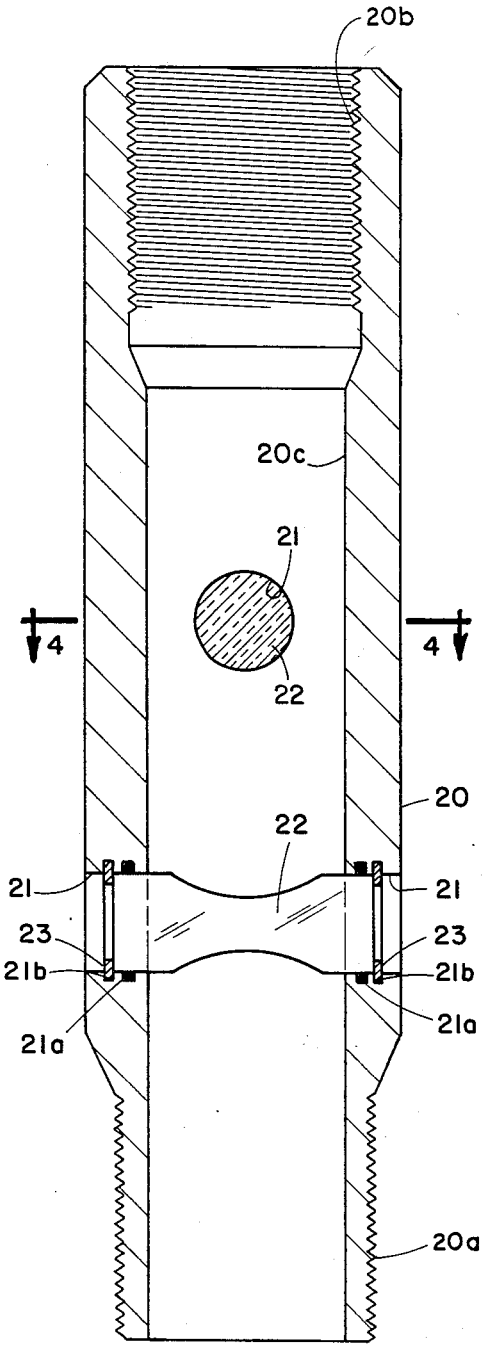
FIG. 3 is an enlarged-scale, vertical sectional view of an underbalancing valve embodying this invention.
Figure 4:
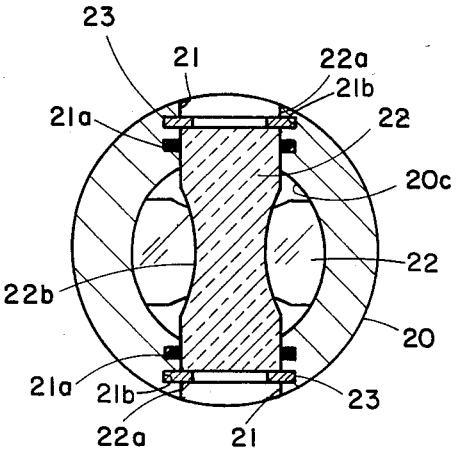
FIG. 4 is a sectional view taken on the plane 4—4 of FIG. 3.

Referring now to FIGS. 3 and 4, the conduit 20 will be seen as comprising a tubular element having threads 20*b* formed at one end for connection at the bottom of the conduit 12 and threads 20*a* formed in the other end for connection to the top of the perforating gun 15. A plurality of axially aligned pairs of holes 21 are then formed in the sidewalls of the conduit 20. The number of such holes is determined by the cross-sectional area of such holes and the total cross-sectional area of the holes should preferably equal the flow passage area of the bore 20*c* of the housing 20. Thus, one or more pairs of holes 21 may be provided.

Within each pair of holes 21, a frangible rod or plug 22 is slidably and sealably mounted. The seal is provided by an 0-ring 21*a* mounted in the bore of each hole 21. While the ends 22*a* of the frangible rods 22 are freely slidable relative to the holes 21, the rods are retained in position, and particularly restrained against radially outward movement, through the provision of a C-ring 23 which is mounted adjacent the outer face of each rod end 22*a* and snaps into a suitable groove 21*b* formed in the respective hole 21. Thus, so long as the frangible rod 21 is intact, it is prevented from movement relative to the holes 21 within which it is mounted and hence such holes are effectively sealed. If desired, the central portion 22*b* of each frangible rod 22 may be of reduced diameter in order to facilitate the breakage of such rod by the downward impact of a detonating bar.

Figure 2:
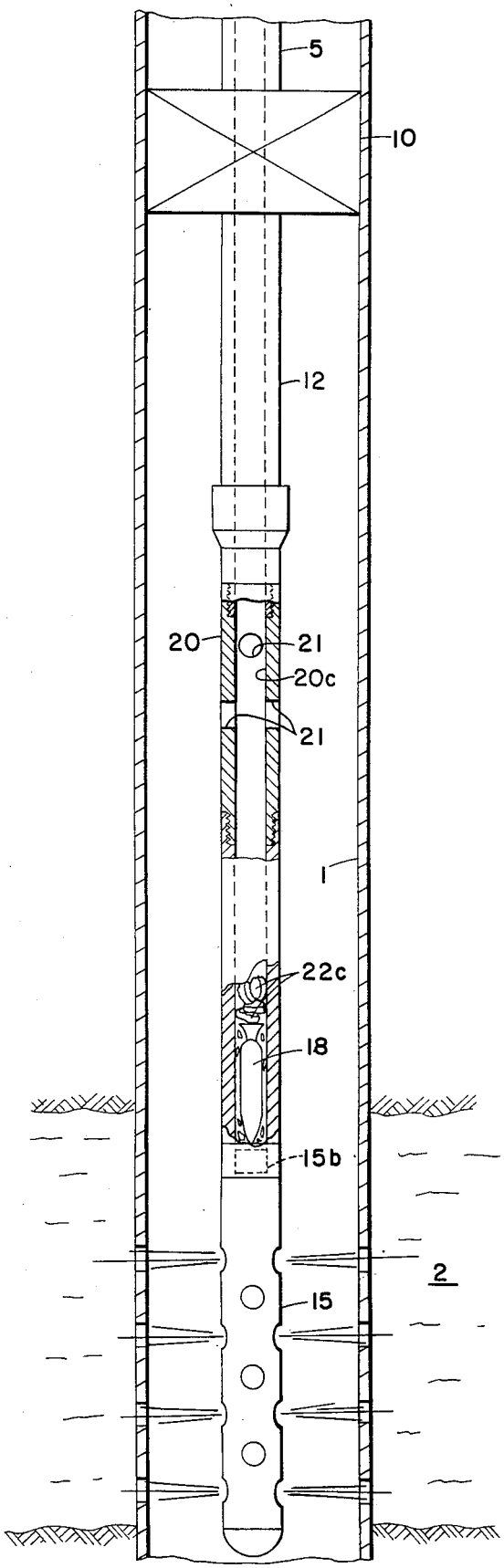
FIG. 2 is a view similar to FIG. 1 but showing the condition of the well after the dropping of detonating bar and the firing of the perforating gun.

Referring now to FIG. 2, there is schematically illustrated the effects of dropping a detonating bar 18 through the bore of the tubing string, hence through the bore 20*c* of the conduit 20, thus impacting each of the frangible rods 21 and breaking such rods as the detonating bar passes.downwardly to impact against the primer 15*b* of the perforating gun 15. The detonation of primer 15*b* by the detonating bar 18 discharges the shaped charges 15*a* and effects the perforation of the wall of well 1 and the adjoining production formation 2.

In accordance with the preferred technique for perforating wells, prior to the firing of the perforating gun, the pressure within the tubing string 5 is reduced to a level substantially below the fluid pressure anticipated to exist within the production formation 2. Hence, immediately subsequent to the firing of the perforating gun, such fluid pressure differential will cause production flow from the production formation and will exert an inward force on the remaining end portions 22*a* of the frangible rods 22, thus forcing such rods end portions inwardly in the holes 21 to fall through the bore 20*c* of the conduit 20 and downwardly around the detonating bar 18 as indicated by the debris 22*c* in FIG. 2. Such removal of the ends 22*a* of the broken frangible bars 22 effects an immediate opening of each of the holes 21 and thus provides a fluid flow passage into the bore 20*c* of the housing 20 adequate to transfer all of the production flow into the bore of the tubing string 5. Due to the lower fluid pressure existing in the conduit 20 and tubing string 5 at the moment of firing the perforating gun, the flow is at a fairly rapid rate and thus insures that debris inherently associated with the firing of the perforating gun will be flushed out of the production formation, and thus will facilitate the free flow of production fluids from such formation.

Those skilled in the art will recognize that the aboredescribed underbalancing valve represents not only a very economical construction, but an entirely reliable valving arrangement that will function to open the tubing string 5 to production flow from the newly perforated formation immediately upon the firing of the perforating gun by the detonating bar 18.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Well perforating apparatus comprising: a tubing-carried perforating gun positionable adjacent a production formation, said gun having an impact detonatable primer at one end; a tubular conduit connectable between a tubing string and the top end of said perforating gun; at least one pair of axially aligned radial holes in the wall of said tubular conduit; and a frangible member traversing the bore of said tubular conduit, the ends of said frangible member being slidably and sealingly mounted in said radial holes, whereby the dropping of a detonating bar through said conduit to detonate said primer breaks said member and opens said radial holes to pressured fluid flow from the perforated production formation.

2. Well perforating apparatus comprising: a tubing-carried perforating gun positionable adjacent a production formation, said gun having an impact detonatable primer in its upper end; a tubular conduit connectable between a tubing string and the top end of said perforating gun; a plurality of pairs of axially aligned, radial holes in the wall of said tubular conduit; and a plurality of frangible members respectively having their ends mounted in slidable, sealing relation in said pairs of radial holes, whereby said frangible members traverse the path of a detonating bar dropped through the tubing string to detonate said primer and fire said perforating gun; said members being constructed and arranged to be broken by the detonating bar and forced out of said holes by pressured fluid from the perforated production formation.

3. A valve for accomplishing underbalanced perforatging of a subterranean well production formation by a tubing-carried perforating gun comprising: a tubular conduit connectable between a tubing string and a perforating gun, said conduit having at least one radial hole in the wall thereof; a frangible member mounted in said radial hole in sealing relationship, whereby a reduced fluid pressure may be maintained in said conduit relative to the fluid pressure external to said tubular conduit; said frangible member having a portion thereof traversing the bore of said tubular conduit, to be impacted by a detonating bar, whereby breakage of said frangible member permits said frangible member to be forced out of said hole by any fluid pressure differential between tubing pressure and annulus pressure adjacent said tubular conduit.

4. A valve for accomplishing underbalanced perforating of a subterranean well production formation by a tubing-carried perforating gun comprising a tubular conduit connectable between a tubing string and a perforating gun, said conduit having at least one pair of axially aligned, radial holes in the wall of said tubular conduit; a frangible seal having its ends respectively slidably and sealably mounted in said radial holes; whereby a reduced fluid pressure may be maintained in said conduit relative to the fluid pressure external to the tubular conduit; said frangible seal having a reduced thickness central portion thereof traversing the bore of said tubular conduit to be impacted by a detonating bar, whereby breakage of said frangible seal permits the ends of said frangible seal to be forced out of said holes by any fluid pressure differential between tubing pressure and annulus pressure adjacent said tubular conduit.

5. A valve for accomplishing underbalanced perforating of a subterranean well production formation by a tubing-carried perforating gun comprising a tubular conduit connectable between a tubing string and a perforating gun, said conduit having a plurality of pairs of axially aligned, radial holes in the wall of said tubular conduit; and a plurality of frangible seals respectively having their ends mounted in slidable, sealing relation in said pairs of radial holes, whereby a reduced fluid pressure may be maintained in said conduit relative to the fluid pressure external to the tubular conduit; said frangible seals having reduced thickness central portions thereof traversing the bore of said tubular conduit to be impacted by a detonating bar, whereby breakage of each said frangible seal permits the ends of said frangible seal to be forced out of said holes by any fluid pressure differential between tubing pressure and annulus pressure adjacent said tubular conduit.

6. The apparatus defined in claims 1 or 2 further comprising means for preventing radially outward movement to the ends of each said frangible seal relative to the respective hole in which each end is slidably and sealably mounted.

7. The apparatus defined in claims 3, 4, or 5 further comprising means for preventing radially outward movement of the ends of each said frangible seal relative to the respective hole in which each end is slidably and sealably mounted.

8. The apparatus defined in claims 1, 2, 4, or 5 wherein the total cross-sectional area of said holes at least equals the area of the bore of said tubular conduit.

9. A combination well packer setting and well perforating apparatus, comprising: a tubing-carried perforating gun positionable adjacent a production formation, said gun having an impact detonatable primer at one end; a tubular conduit connectable between a tubing string at the top end of said perforating gun; a well packer carriable into the well on said tubular conduit and activatable from an initial retracted position to a second position at a predeterminedable depth within the well, whereby, in said second position, said well packer isolates a portion of the well exterior of said conduit and below said well packer from a portion of said well exterior of said conduit above said well packer, said well packer being activatable from said first position to said second position by fluid pressure defined within said well conduit; at least one pair of axially aligned radial holes in the wall of said tubular conduit; and a frangible member traversing the bore of said tubular conduit, the ends of said frangible member being slidably and sealingly mounted in said radial holes, whereby said well packer may be set by increase of fluid pressure within said conduit and whereby thereafter the dropping of a detonating bar through said conduit to detonate said primer breaks said member and opens said radial holes to pressured fluid flow from the perforated production formation.

* * * * *